US007539432B2

(12) United States Patent
Dan

(10) Patent No.: US 7,539,432 B2
(45) Date of Patent: May 26, 2009

(54) IMAGE FORMING APPARATUS

(75) Inventor: Kenichi Dan, Nagoya (JP)

(73) Assignee: Brother Kogyo Kabushiki Kaisha, Aichi (JP)

( * ) Notice: Subject to any disclaimer, the term of this patent is extended or adjusted under 35 U.S.C. 154(b) by 164 days.

(21) Appl. No.: 11/878,689

(22) Filed: Jul. 26, 2007

(65) Prior Publication Data

US 2008/0031649 A1 Feb. 7, 2008

(30) Foreign Application Priority Data

Aug. 2, 2006 (JP) ..... 2006-210940

(51) Int. Cl.
*G03G 15/20* (2006.01)

(52) U.S. Cl. ..... 399/71

(58) Field of Classification Search ..... 399/71, 399/16, 43, 82, 401, 107, 123, 343, 344
See application file for complete search history.

(56) References Cited

U.S. PATENT DOCUMENTS

| | | | | |
|---|---|---|---|---|
| 5,528,350 | A * | 6/1996 | Tanaka et al. | 399/45 |
| 6,201,944 | B1 | 3/2001 | Onuki et al. | |
| 6,445,899 | B2 | 9/2002 | Sato | |
| 7,049,037 | B2 * | 5/2006 | Katoh et al. | 430/47.2 |
| 7,460,800 | B2 * | 12/2008 | Yamauchi et al. | 399/38 |
| 2001/0002953 | A1 | 6/2001 | Sato | |
| 2007/0134016 | A1 * | 6/2007 | Watanabe et al. | 399/66 |
| 2008/0038010 | A1 * | 2/2008 | Ichikawa et al. | 399/100 |

FOREIGN PATENT DOCUMENTS

| | | |
|---|---|---|
| JP | 10-274902 | 10/1998 |
| JP | 11-072989 | 3/1999 |
| JP | 11-258862 | 9/1999 |
| JP | 2000-29365 | 1/2000 |
| JP | 2001-166556 | 6/2001 |
| JP | 2002-337417 | 11/2002 |
| JP | 2003-140470 | 5/2003 |
| JP | 2003-162109 | 6/2003 |
| JP | 2003-312098 | 11/2003 |
| JP | 2004-029209 | 1/2004 |
| JP | 2004-101968 | 4/2004 |
| JP | 2004-212883 | 7/2004 |

OTHER PUBLICATIONS

Japanese Notice of Reasons for Refusal, with English translation thereof, issued in Patent Application No. JP 2006-210940 dated on Jul. 8, 2008.

* cited by examiner

*Primary Examiner*—John A Ward
(74) *Attorney, Agent, or Firm*—McDermott Will & Emery LLP

(57) ABSTRACT

An image forming apparatus includes a photoreceptor, a photoreceptor cleaner configured to clean the photoreceptor, a belt configured to be arranged opposite to the photoreceptor, a belt cleaner configured to clean the belt, a medium supplying device configured to perform supply operation of an image forming medium at a predetermined supply interval time, and a control device configured to perform cleaning processing when a cleaning processing time is less than the predetermined supply interval time.

38 Claims, 9 Drawing Sheets

IMAGE FORMING APPARATUS

CROSS REFERENCE TO RELATED APPLICATION

This application claims priority from Japanese Patent Application No. 2006-210940 filed on Aug. 2, 2006. The entire content of this priority application is incorporated herein by reference.

TECHNICAL FIELD

The present disclosure relates to an image forming apparatus.

BACKGROUND

In a conventional image forming apparatus, a toner image formed on a photoreceptor drum is transferred onto a sheet. In such image forming apparatus, for example, the surface of the photoreceptor needs to be cleaned in order to form a high quality image. For this purpose, there is known a technique in which, when matter stuck to the photoreceptor are collected by a photoreceptor cleaner, a belt cleaner is able to collect the stuck matters via the photoreceptor cleaner and a belt at a predetermined timing.

The above described technique needs time to performing the collecting processing separately from the image formation processing time (printing time), and thus resulting in the throughput of image formation to be slowed, which causes image formation to be inefficient. Thus, there is a need in the art for an image forming apparatus capable of effectively collecting matter stuck to the photoreceptor, and highly efficiently realizing both the collecting processing and the image formation processing without disadvantageously slowing the throughput of image formation.

SUMMARY

An image forming apparatus according to one aspect of the present invention the present invention may include a photoreceptor, a photoreceptor cleaner configured to clean the photoreceptor, a belt configured to be arranged opposite to the photoreceptor, a belt cleaner configured to clean the belt, a medium supplying device configured to perform supply operation of an image forming medium at a predetermined supply interval time, and a control device configured to perform cleaning processing when a cleaning processing time is less than the predetermined supply interval time.

According to the image forming apparatus, the predetermined supply interval time is determined, and the photoreceptor cleaner is cleaned based on the predetermined supply interval time. Thereby, it is possible to effectively utilize the period in which the image formation is not performed. That is, since image formation such as printing is not performed during the interval between the supply operations, it is possible to improve the efficiency of the image formation by cleaning the photoreceptor cleaner by use of the interval. However, in the case where the supply interval is fixed (no difference between supply intervals is provided), and where the cleaning processing is performed during the fixed supply interval, when the supply interval is short, sufficient cleaning may not be performed, and on the other hand, when the supply interval is long, the speed of image formation may be lowered to cause the image formation to be inefficient. Thus, as in the present invention, when a difference between supply intervals is provided to make the cleaning processing performed during the long supply interval, it is possible to avoid the above described problem and to realize both sure cleaning and quick printing.

BRIEF DESCRIPTION OF THE DRAWINGS

Illustrative aspects in accordance with the invention will be described in detail with reference to the following figures wherein.

DETAILED DESCRIPTION OF THE PREFERRED ILLUSTRATIVE ASPECTS

Next, one aspect of the present invention will be described with reference to the accompanying drawings.

(1) Whole Constitution of Laser Printer

Figure 1:
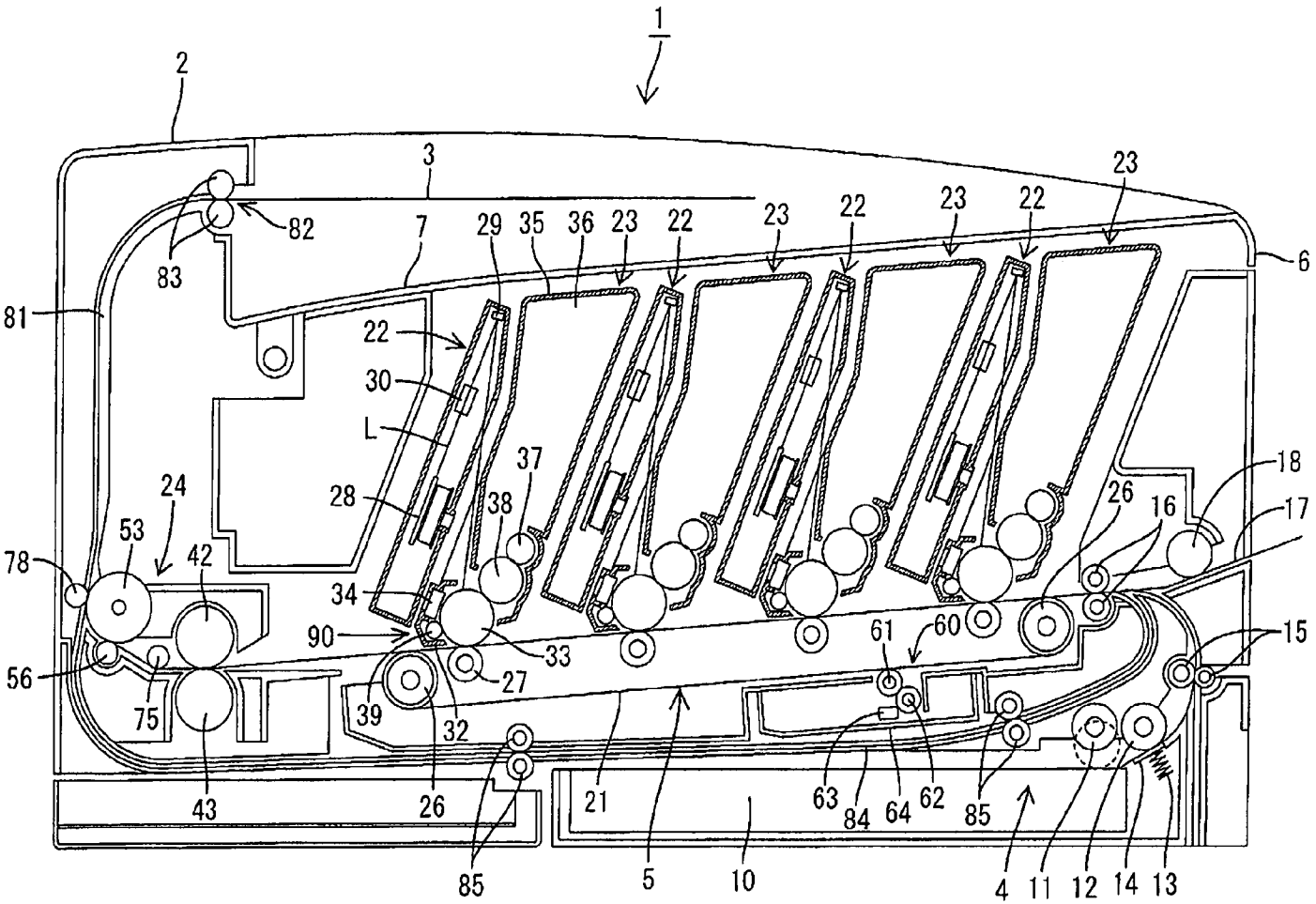
FIG. 1 is a sectional side view showing a laser printer according to one aspect of the present invention.

FIG. 1 is a sectional side view showing a laser printer 1, which is one example of an image forming apparatus according to one aspect of the present invention. The laser printer 1 can be a direct tandem-type color laser printer having photoreceptor drums (photoreceptors) 33 corresponding to various colors (i.e. black, cyan, magenta and yellow). Note that in the following explanation, the right hand side in FIG. 1 is taken as the front side of the printer.

As shown in FIG. 1, the laser printer 1 includes a box-shaped main body casing 2 as a whole, in which a feeder portion (medium supplying device) 4 for supplying a sheet 3 (as an image forming medium; the sheet can be, but is limited to, paper, plastic, and the like), an image forming portion 5 for forming an image on the sheet 3 supplied by the feeder portion, and the like, are provided. An openable and closable upper surface cover 6 is provided on the upper surface of the main body casing 2. It is possible to exchange process cartridges 23 in the main body casing 2 by opening the upper surface cover 6. Further, a discharge tray 7 to be loaded with sheets 3 (for printing) is formed in the upper surface of the upper surface cover 6.

(2) Feeder Portion

The feeder portion 4 includes a feed tray 10 detachably mounted in the bottom portion of the main body casing 2, a pickup roller 11 and a feeding roller 12 which are arranged above the front end of the feed tray 10 in parallel with each other in the front and rear direction, a separation pad 14 press contacted to the feeding roller 12 by energization of a spring 13, a pair of sheet powder removing rollers 15 provided in the front side above the feeding roller 12, and a pair of resist rollers 16 provided in the rear side above the sheet powder removing roller 15.

On the bottom surface of the feed tray 10, a tiltable pressing plate (not shown) is provided so as to raise the front end side of the sheet 3. The sheet 3 loaded at the uppermost position of the feed tray 10 is pressed by the energizing force of the pressing plate toward the pickup roller 11, and starts to be conveyed toward between the feeding roller 12 and the separation pad 14 by the rotation of the pickup roller 11. Then, when the sheet 3 is inserted between the feeding roller 12 and the separation pad 14 by the rotation of the feeding roller 12, the sheet 3 is separated one by one so as to be sent in the slant upper direction. The one sheet, whose powder is removed by the pair of powder removing rollers 15, is then conveyed by the resist roller 16. Further, a supply opening 17 for manually supplying the sheets 3 is provided in the front surface of the main body casing 2. The sheet 3 supplied from the supply opening 17 is similarly conveyed by a manual feeding roller 18 to the side of the resist roller 16. After correcting the skew of the sheet 3 by rotating in the opposite direction to the conveyance direction, the resist roller 16 sends the sheet 3 onto a conveying belt 21 by being switched to the normal rotation at a predetermined timing.

(3) Image Forming Portion

The image forming portion 5 can include the conveying belt 21, a scanner portion 22, the process cartridge 23, a fixing device 24 and the like.

(a) Conveying Belt

The conveying belt 21 is stretched in a state as slightly inclined with its rear end kept lower between a pair of belt supporting rollers 26 which are arranged to be separated from each other in the front and rear direction, and is circularly moved when the belt supporting roller 26 on the rear side is rotatably driven. Inside the conveying belt 21, the transfer rollers 27 arranged opposite each photoreceptor drum 33, which is provided in the process cartridge 23 and will be described below, are provided in parallel with each other at a fixed interval in the front and rear direction, so as to be in the state where the conveying belt 21 is inserted between the each photoreceptor drum 33 and the transfer roller 27 corresponding to the each photoreceptor drum 33.

(b) Scanner Portion

Above the conveying belt 21, the four scanner portions 22 as exposure means are arranged in parallel with each other at a fixed interval in the front and rear direction. The scanner portion 22 includes a polygon mirror 28 adapted to reflect a laser beam L emitted by a laser diode (not shown) so as to successively change the direction of the laser beam L along a predetermined surface, a turning-back mirror 29 adapted to reflect the laser beam L reflected by the polygon mirror 28, toward the photoreceptor drum 33 of the process cartridge 23, an fθ lens 30 provided in the optical path of the laser beam L, and the like.

(c) Process Cartridge

Process cartridges 23 are provided corresponding to various colors (i.e. magenta, yellow, cyan and black), and are detachably mounted in the front side of the each scanner portion 22 above the conveying belt 21. The process cartridge 23 includes the photoreceptor drum 33 and a charger 34 (i.e. of the scorotron type) in the lower part of a frame shaped cartridge frame 32, and includes a developing cartridge 35 in the upper side of the cartridge frame 32.

The photoreceptor drum 33 has a cylindrical shape and a drum body formed of a positively electrifiable photosensitive layer whose outermost surface layer is made of polycarbonate or the like, is attached to a metal drum shaft. The photoreceptor drum 33 is rotatably driven by a motor (not shown).

The charger 34 is arranged opposite the photoreceptor drum 33 at a predetermined space so as not to be in contact with the photoreceptor drum 33, in a slant upper part on the rear side of the photoreceptor drum 33. This charger 34 uniformly electrifies the surface of the photoreceptor drum 33 to the positive polarity by generating corona discharge by a wire for electrification made of tungsten or the like.

The developing cartridge 35 has a box shape opened in the bottom side, and is detachably mounted to the cartridge frame 32. A toner storage chamber 36 filled with a toner made of a nonmagnetic component having positive electrification property, as a developer, is provided in the upper part of the developing cartridge 35. A supply roller 37, a developing roller 38, a layer thickness regulating blade (not shown) and the like are provided in the lower side of the toner storage chamber 36.

The supply roller 37 is rotatably supported to the developing cartridge 35, and is rotatably driven by a motor (not shown).

The developing roller 38 is rotatably supported to the developing cartridge 35 in a slant lower part on the rear side of the supply roller 37, in the state of being in press contact with the supply roller 37. Further, the developing roller 38 is brought oppositely in contact with the photoreceptor drum 33 in the state where the developing cartridge 35 is loaded to the cartridge frame 32. The developing roller 38 is rotatably driven by a motor (not shown).

The toner discharged from the toner storage chamber 36 is supplied to the developing roller 38 by the rotation of the supply roller 37, and at this time, triboelectrically charged to the positive polarity between the supply roller 37 and the developing roller 38. The toner supplied onto the developing roller 38 enters between the pressing portion of the layer thickness regulating blade and the developing roller 38 in accordance with the rotation of the developing roller 38, so as to be carried on the developing roller 38 as a thin layer having a fixed thickness.

The surface of the photoreceptor drum 33 is first uniformly charged to the positive polarity by the charger 34 in accordance with the rotation of the developing roller 38, and then exposed by high-speed scanning of the laser beam L from the scanner portion 22, so that an electrostatic latent image corresponding to an image to be formed on the sheet 3 is formed on the surface of the photoreceptor drum 33.

Then, the toner carried on the developing roller 38 and charged to the positive polarity, when being brought oppositely in contact with the photoreceptor drum 33 by the rotation of the developing roller 38, is supplied to the electrostatic latent image formed on the surface of the photoreceptor drum 33. Thereby, the electrostatic latent image of the photoreceptor drum 33 is made into a visible image, and a toner image formed by reversal development is carried on the surface of the photoreceptor drum 33.

Thereafter, the toner image carried on the surface of the photoreceptor drum 33 is transferred on the sheet 3 by a transfer bias voltage applied to the transfer roller 27, while the sheet 3 conveyed by the conveying belt 21 passes through the transfer position between the photoreceptor drum 33 and the transfer roller 27. Then, the sheet 3 on which the toner image corresponding to each color is transferred, is conveyed to the fixing device 24.

In the fixing device 24, the toner image is heat fixed on the sheet surface by heating the sheet 3. The fixing device 24 is arranged in the downstream (rear) side from the transfer position between the photoreceptor drum 33 and the transfer roller 27. The fixing device 24 includes a heating roller 42, a pressing roller 43, and the like.

(4) Sheet Conveyance Path after Fixation

In the rear portion in the main body casing 2, there is provided an arc shaped path 81 for supplying the sheet subjected to the toner fixation to the side of the discharge tray 7, and a discharge opening 82 is provided at the upper end of the arc shaped path 81. In the discharge opening 82, a vertical pair of upper discharge rollers 83 are provided, so that the sheet 3 sent from the arc shaped path 81 is discharged on the discharge tray 7 by the upper discharge rollers 83. Further, in the lower portion of the main body casing 2, a re-conveyance path 84 running toward the front of the main body casing 2 is formed, as shown in FIG. 1. Relay rollers 85 for conveying the sheet 3 are provided at two positions in the re-conveyance path 84. The re-conveyance path 84 branches from the lower end of the arc shaped path 81 at a rear position through the fixing device 24 in the front portion of the main body casing 2, passes below the conveying belt 21, and returns to the rear portion of the main body casing 2 to be folded back, thereby being connected to a position just before the resist roller 16.

Therefore, the present laser printer 1 includes the conveyance path in which the sheet 3 subjected to the heat fixation is conveyed toward the discharge tray 7 through the arc shaped path 81, and the conveyance path in which the sheet 3 is again conveyed toward the image forming portion 5 through the re-conveyance path 84 at the time of double-side printing or the like. At the time of double-side printing, after the sheet 3 (subjected to the heat fixation) is conveyed into the arc shaped path 81, the advancing direction of the sheet 3 is reversed there, so that the sheet 3 is made to advance into the re-conveyance path 84 and thereby turned over.

(5) Cleaning Portion

In the rear of the photoreceptor drum 33, a first cleaning portion 90 capable of cleaning matter stuck to the photoreceptor drum 33 is arranged. The first cleaning portion 90 can include a cleaning roller (photoreceptor cleaner) 39 formed in the downstream side of the transfer roller 27 and in the upstream side of the charger 34. The cleaning roller 39 is adapted to clean the photoreceptor drum 33 after the transfer onto the sheet 3 is performed by the transfer roller 27, and to be capable of collecting matter, such as sheet powder and residual toner, that is stuck to the photoreceptor drum 33 by a bias voltage applied to the cleaning roller 39.

Further, in the lower part of the conveying belt 21, there is provided a second cleaning portion 60 adapted to collect and store the matter collected by the above described first cleaning portion 90 and matter stuck to the conveying belt 21, and the like. The second cleaning portion 60 includes a primary cleaning roller 61, a secondary cleaning roller 62, a scraping blade 63, and a collected matter storage portion 64.

The primary cleaning roller 61 is arranged so as to be in contact with the conveying belt 21 at its lower side opposite to its upper side in contact with the photoreceptor drum 33 and the transfer roller 27. The primary cleaning roller 61 is provided so as to be rotatably driven in the same direction as the circulating direction of the conveying belt 21 at the above described contact position. A primary cleaning bias is applied to the primary cleaning roller 61 at the time of the cleaning processing.

The secondary cleaning roller 62 is arranged so as to be in contact with the primary cleaning roller 61 from its lower side, and to be rotated in the direction opposite to the direction of rotation of the primary cleaning roller 61 at the contact position. A secondary cleaning bias is also applied to the secondary cleaning roller 62 at the time of the cleaning processing. Note that the scraping blade 63 is provided to be in contact with the secondary cleaning roller 62 from its lower side.

The collected matter storage portion 64 is provided below the primary cleaning roller 61 and the secondary cleaning roller 62, so as to be capable of storing the collected matters such as dust falling from the secondary cleaning roller 62.

(6) Cleaning Processing

The matter collected from the photoreceptor drum 33 by the cleaning roller 39 is re-collected in the collected matter storage portion 64 by the cleaning processing. Specifically, while the matter collected by the cleaning roller 39 are transferred to the photoreceptor drum 33, the collected matters are transferred from the photoreceptor drum 33 to the conveying belt 21, and therefore transferred into the collected matter storage portion 64 from the conveying belt 21 via the rollers 61 and 62 and the scraping blade 63. The cleaning processing can be simultaneously performed to each photoreceptor drum 33. That is, it is configured so that the each cleaning roller 39 provided for each photoreceptor drum 33 transfers the collected matter simultaneously transferred to each photoreceptor drum 33, and the collected matter transferred to each photoreceptor drum are transferred into the collected matter storage portion 64 from the conveying belt 21.

During the cleaning processing which is the re-collection processing of the collected matter from the cleaning roller 39 to the collected matter storage portion 64, as described above, the photoreceptor drum 33 and the conveying belt 21 can accumulate matter (such as sheet powder/dust and/or toner, and the like), and hence it is necessary to stop the supply of the sheet 3. In this situation, the photoreceptor drum 33 and the conveying belt 21 are not in the state where image formation such as printing can be accurately and efficiently performed. Therefore, in the present aspect of the invention, in order to accurately perform the cleaning processing while efficiently supplying the sheet 3, a cleaning processing control is provided so that the cleaning processing is performed at a predetermined timing.

Figure 2:
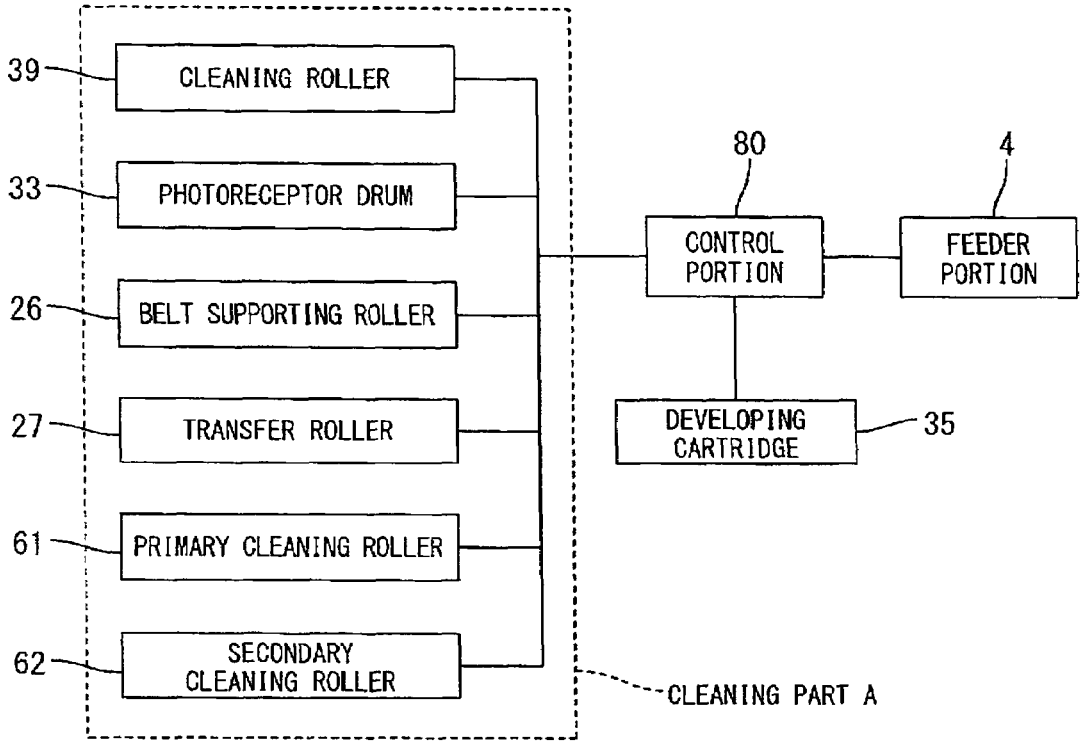
FIG. 2 is a block diagram of a cleaning control mechanism adapted to perform cleaning processing.

FIG. 2 is a block diagram of a cleaning control mechanism which performs the cleaning processing control. In the present aspect of the invention, the control portion 80 is adapted to perform the control of the above described cleaning processing, and to issue a predetermined operating command to a cleaning portion A, the feeder portion 4, the developing cartridge 35 and the like at a predetermined timing.

The content of the cleaning processing control performed by the control portion 80 will now be explained.

First, the control portion 80 determines the execution timing of the cleaning processing on the basis of the sheet supply information from the feeder portion 4. Specifically, the control portion 80 acquires the supply interval information (or the predetermined supply interval time) of the sheet 3 from the conveying timing of the resist roller 16 of the feeder portion 4, and performs the cleaning processing control on the basis of the acquired supply interval information. Cleaning processing is performed when a period of time to perform cleaning processing is less than the predetermined supply interval time. Here, it is assumed that when the double-side printing is performed, a difference between the supply intervals of the sheet 3 is provided, and the cleaning processing is performed during a long supply interval (i.e. the cleaning processing time is less than the predetermined supply interval time during the double-side printing mode).

Figure 7:
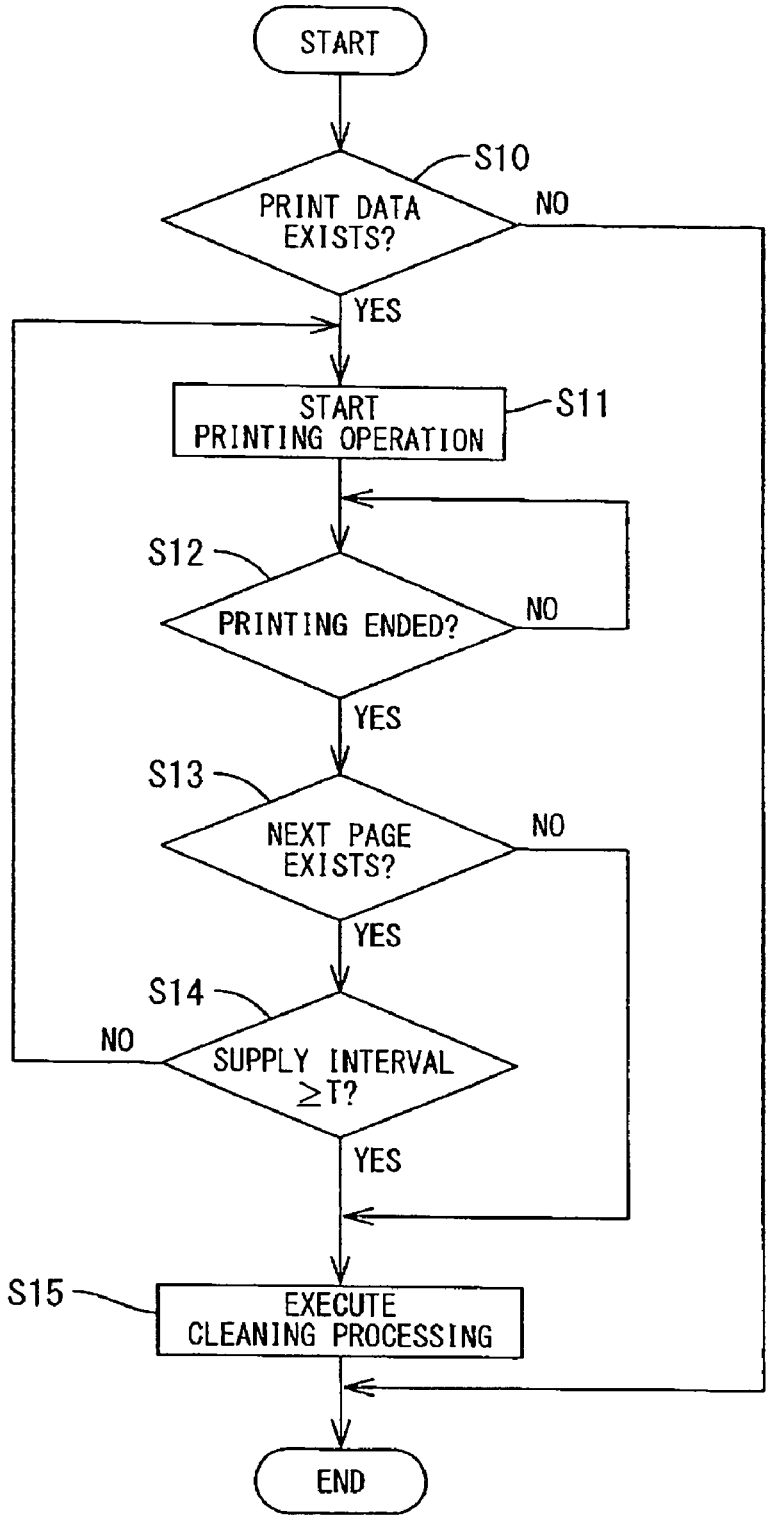
FIG. 7 is a flow chart showing a flow of cleaning processing control in a double-side printing mode.

FIG. 7 is a flow chart showing the flow of the cleaning processing control.

First, the presence and absence of print data are confirmed in S10. When print data exists, the process proceeds to S11, in which a printing operation is started. When print data does not exist, the processing is ended. Then, when the completion of the printing operation for one page is confirmed (YES in S12), the presence and absence of next page are confirmed in S13. When the next page does not exist (NO in S13), the process proceeds to S15, in which the cleaning processing is performed. When the next page exists (YES in S13), a sheet supply interval is confirmed in S14. When the predetermined supply interval time is T or longer (YES in S14), the cleaning processing is performed (S15). Further, when the sheet supply interval is confirmed in S14, and the supply interval is shorter than T (NO in S14), the process returns to the processing in S11. In the present aspect of the invention, T is set as the distance between the photoreceptor drum 33 (photoreceptor drum 33 at the right end in FIG. 1) in the most upstream side in the belt conveyance direction among the photoreceptor drums 33, and the photoreceptor drum 33 (photoreceptor drum 33 at the left end in FIG. 1) in the most downstream side.

Prior to execution of the cleaning processing, the control portion 80 transmits a standby command signal to the developing cartridge 35 in order to separate the developing roller 38 from the photoreceptor drum 33. The developing cartridge 35 performs an operation to separate each developing roller 38 from the photoreceptor drum 33 according to this command. This makes it possible to prevent the occurrence of failures such as matter getting stuck on the developing roller 38, and instead ensures that the matter to be collected is stuck to the photoreceptor drum 33.

Further, in order to perform the cleaning processing, the control portion 80 simultaneously applies a bias to each cleaning roller 39, so that the collected matter are re-stuck to each photoreceptor drum 33. Then, in order to collect the collected matter re-stuck to each photoreceptor drum 33 by the conveying belt 21, the control portion 80 applies a bias to each transfer roller 27. Further, in order to transfer the matter collected onto the conveying belt 21 in the storage portion 64, the control portion 80 applies a bias to the primary cleaning roller 61 and the secondary cleaning roller 62, so that the collected matter are eventually scraped by the scraping blade 63 from the secondary cleaning roller 62, and a series of cleaning processing is completed.

Meanwhile, in the present aspect of the invention, as described above, the control for executing the cleaning processing is performed during the "long" supply interval (the predetermined supply interval time is greater than a cleaning processing time). In the following, the processing timing will be described in more detail.

Figure 3:
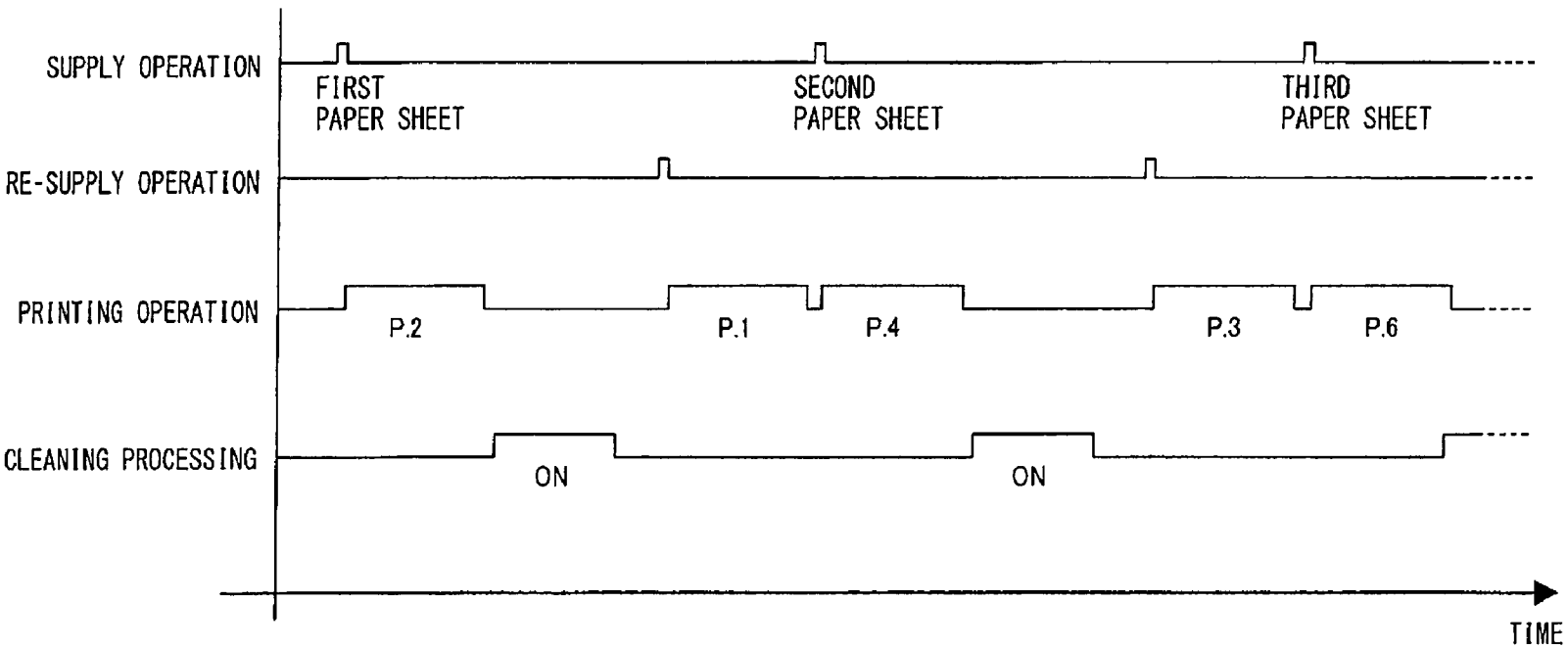
FIG. 3 is a timing chart for explaining timings at which cleaning processing is performed in a double-side printing mode.

FIG. 3 is a timing chart for explaining timings for performing the cleaning processing at the time of the double-side printing mode. In the figure whose horizontal axis represents time, the timings of the supply operation, the printing operation, and the cleaning processing are shown, respectively. Reference characters P. 1, P. 2, P. 3, etc., in the printing operation timing denote printing operations of the first page, the second page, the third page, etc. of a document to be printed, respectively.

The supply operation and the printing operation are performed as follows. First, a sheet 3 positioned at the upper most position among the sheets stacked in the feed tray 10 is taken out by the pickup roller 11, and conveyed by the conveying belt 21 in a state where the lower surface of the sheet 3 is turned upward. The second page of the document is printed on the first sheet 3 (printing operation P.2). Then, after the sheet 3 advances into the arc shaped path 81, the advancing direction of the sheet 3 is reversed. As a result, the sheet 3 advances into the re-conveyance path 84, to thereby be turned over. Then, the first page of the document is printed in a process in which the sheet 3 is conveyed again by the conveying belt 21 through the re-conveyance path 84 (printing operation P. 1). Next, the second sheet 3 is taken out from the feed tray 10, and supplied on the conveying belt 21. After the fourth page of the document is printed on the sheet 3 (printing operation P. 4), the sheet 3 is supplied again on the conveying belt 21 through the re-conveyance path 84, so that the third page is printed on the sheet 3 (printing operation P. 3).

The cleaning processing is performed while the printing operation is not performed. Here, the cleaning processing is configured to be performed by utilizing the period between two printing operations at the time of double-side printing, that is, by utilizing the period between after the one sheet 3 is supplied and its back surface side is printed, and before the same sheet 3 is re-conveyed on the conveying belt 21 through the re-conveyance path 84. Therefore, as shown in the timing chart in FIG. 3, the above described cleaning processing is performed at the timing shown by "ON" in FIG. 3 during the period between after the first sheet 3 is supplied and subjected to the printing operation (P. 2), and before the sheet 3 (P. 1) is re-conveyed so as to be supplied again and subjected to the printing operation (P. 1).

As described above, in the double-side printing mode, since the predetermined supply interval is "long" at the time of re-conveyance of the sheet, the control to execute the cleaning processing is performed by utilizing the long interval. This makes it possible to execute the highly efficient cleaning processing. However, in the laser printer 1 according to the present aspect of the invention, the cleaning processing control is able adapt to the other print mode, thus making it possible for the control portion 80 to suitably execute the cleaning processing for other print modes.

Figure 4:
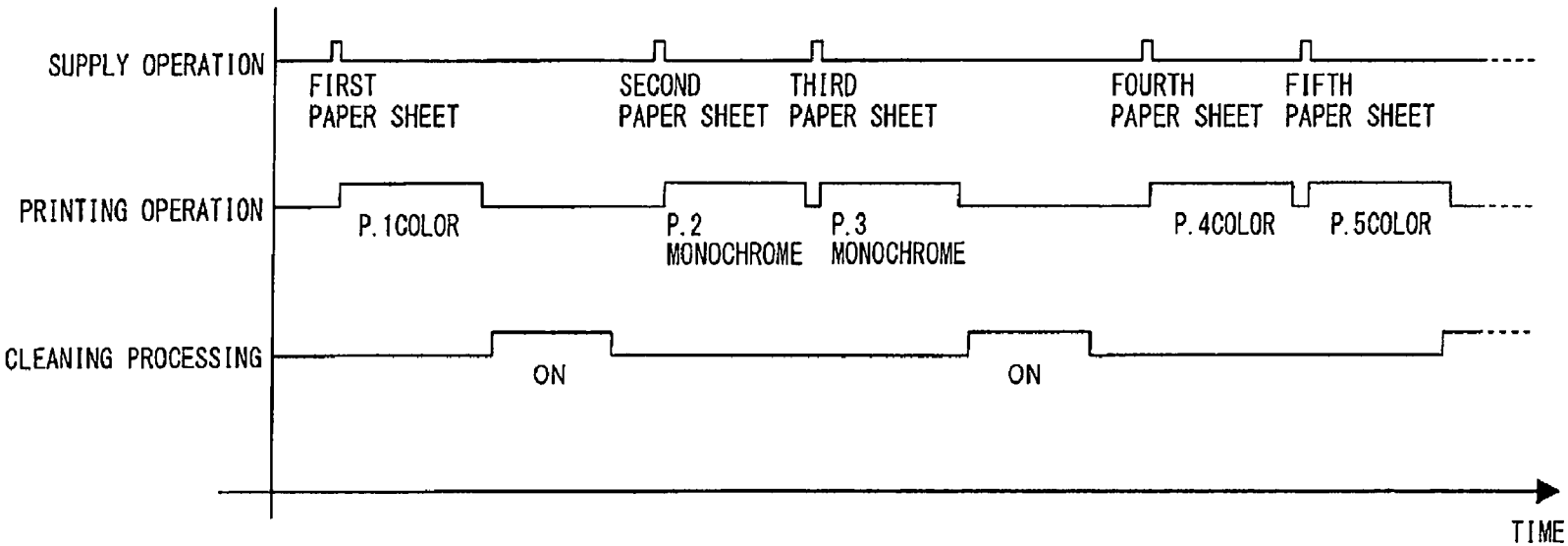
FIG. 4 is a timing chart for explaining timings at which cleaning processing is performed in a mode for interchangeably performing monochromatic printing and color printing.

FIG. 4 is a timing chart for explaining timings for executing a cleaning process in a mode in which the monochromatic printing and the color printing are interchangeably executed. In the figure whose horizontal axis represents time, the timings of the supply operation, the printing operation, and the cleaning processing are shown, respectively.

The supply operation is the conveying operation of the sheet 3, which is performed by the resist roller 16 and the like, and in which the sheet supply is performed in the order of the first sheet 3, the second sheet 3, the third sheet 3, the fourth sheet 3, the fifth sheet 3, etc.

The printing operation is an image forming operation applied to the sheet 3, which is performed by the image forming portion 5 after the supply from the resist roller 16 and the like, and the printing is configured to end within a predetermined period of time after the supply operation is performed. Here, the printing mode of the monochromatic printing or the color printing is different for each page. As a result, the color printing is performed for the first page (P. 1), the monochromatic printing is performed for the second and third sheets (P. 2, P. 3), and the color printing is performed for the fourth and fifth sheets (P. 4, P. 5).

The cleaning processing is configured to be performed while the printing operation is not performed. In this print mode, the cartridges are switched so as to correspond to the monochromatic printing or the color printing, and hence the cleaning processing is configured to be performed during the switching period (the switching period being one example of a predetermined supply interval time).

Specifically, the process cartridge 23 for color printing is put on standby at the time of the monochromatic printing. On the other hand, at the time of the color printing, the switching is performed so as to shift (release the standby state of) the process cartridge 23 for color printing to a printable state. Specifically, as shown in the timing chart in FIG. 4, after the first sheet is supplied and the color printing is performed to the first sheet, the above described cleaning processing is executed within the above described switching period (period shown by "ON" in FIG. 4), and thereafter, the second sheet is supplied and the monochromatic printing to the second sheet is performed.

Figure 5:
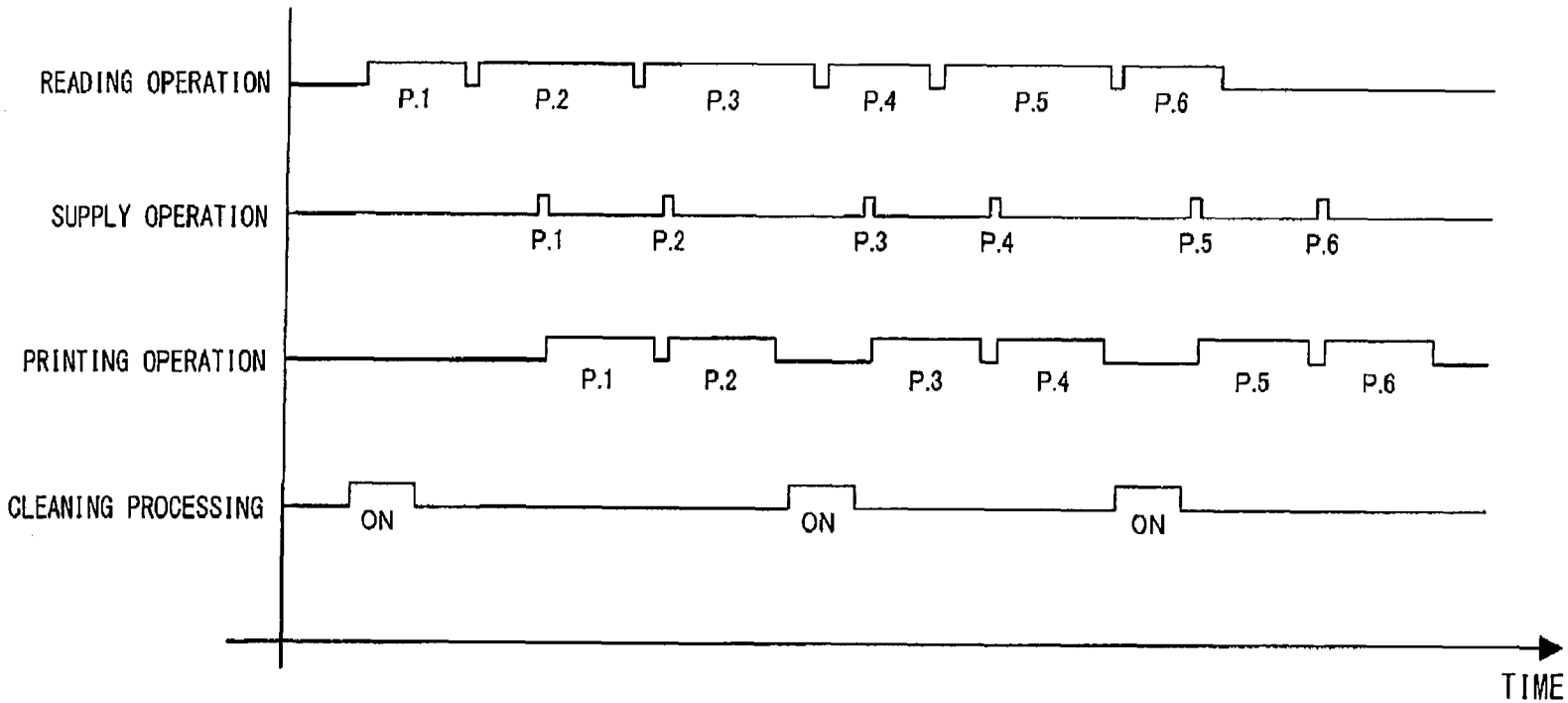
FIG. 5 is a timing chart for explaining timings at which cleaning processing is performed in a facsimile mode.

FIG. 5 is a timing chart for explaining timings for executing a cleaning process in a facsimile mode. The laser printer 1 can be connected to a telephone line, and loaded with the facsimile function of reading and printing image data received via the telephone line. In FIG. 5 whose horizontal axis represents time, the timings of the reading operation, the supply operation, the printing operation, and the cleaning processing are shown, respectively.

The reading operation is an operation performed by a received image reading portion (not shown) for reading the transmitted image data, in which operation the reading is performed at the timings of the first sheet (P. 1), the second sheet (P. 2), the third sheet (P. 3), the fourth sheet (P. 4), the fifth sheet (P. 5), the sixth sheet (P. 6), etc. Since the data amount of the transmitted image data is different for each page, the reading time (reception time period) is also different for each page.

The supply operation is a conveying operation of the sheet 3 performed by the resist roller 16, in which operation the supply is performed at the timings of the first sheet (P. 1), the second sheet (P. 2), the third sheet (P. 3), the fourth sheet (P. 4), the fifth sheet (P. 5), the sixth sheet (P. 6), etc. Here, after the above described reading operation of a predetermined page is completed, the supply operation of the corresponding page is performed. Since the reading time is different for each page as described above, the supply operation interval is also adapted to be different for each page.

The printing operation is an image forming operation to the sheet 3 performed by the image forming portion 5 after the supply from the resist roller 16 and the like, and is adapted to be completed within a predetermined period of time after the supply operation is performed.

The cleaning processing is configured to be performed while the printing operation is not performed (between sheets). In the facsimile mode, it is adapted that when the supply operation is performed prior to the reading operation, that is, when the sheet supply is put on standby, and thus the cleaning processing is performed by utilizing the sheet supply standby time (one example of a predetermined supply interval time).

Specifically, as shown in the timing chart in FIG. 5, the cleaning processing is adapted to be performed within the sheet supply standby period (period shown by "ON" in FIG. 5) between after the second sheet (P. 2) is supplied and printed, and before the reading for the third sheet (P. 3) is completed. Further, the cleaning processing is also configured to be performed within the sheet supply standby period of the fifth sheet (P. 5) after the fourth sheet (P. 4) is supplied and printed. Further, the cleaning processing is also performed within the supply standby period (period shown by "ON" in FIG. 5) before the reading for the first sheet (P. 1) is completed.

Figure 6:
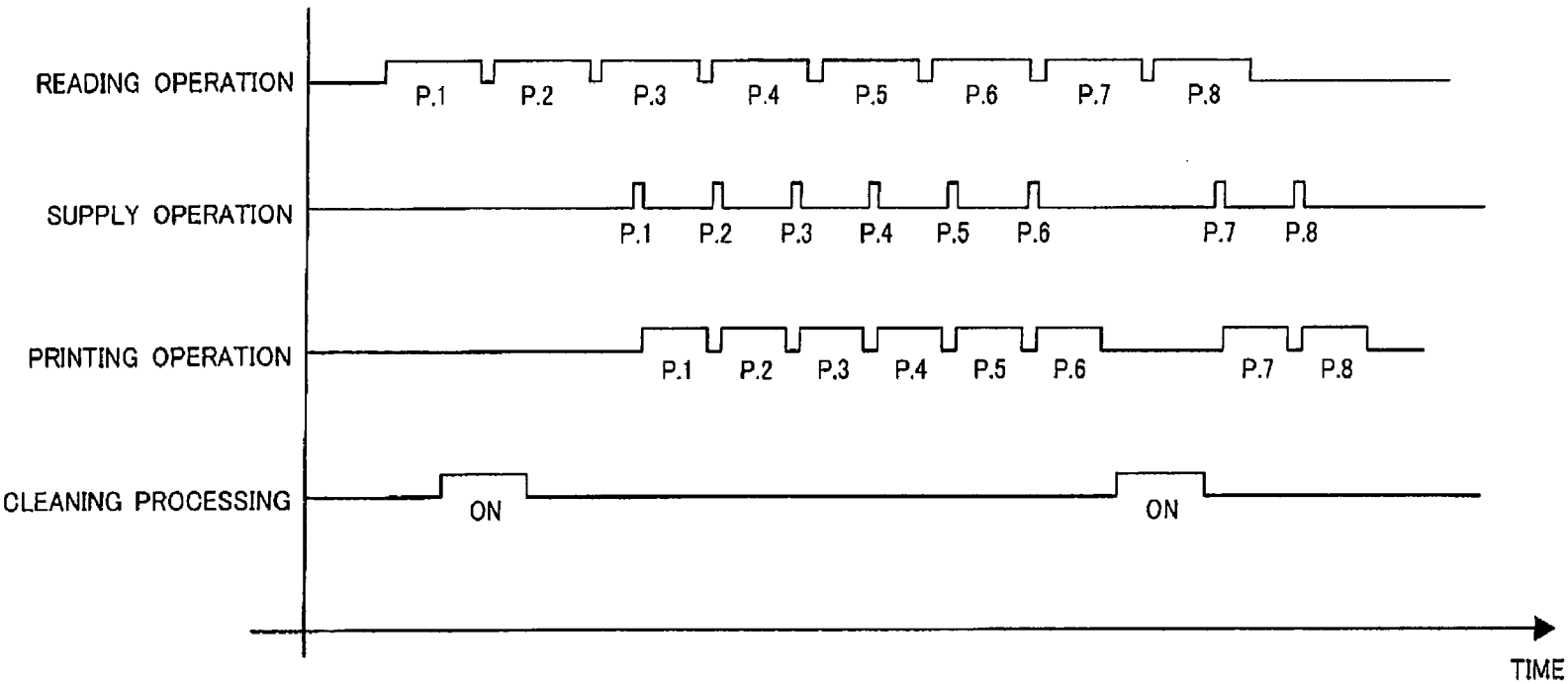
FIG. 6 is a timing chart for explaining timings at which cleaning processing is performed in a continuous copying mode.

Further, FIG. 6 is a timing chart for explaining timings for executing a cleaning process in a continuous copying mode. For example, the control of the cleaning processing is also performed in the mode in which continuous copying is performed in the laser printer 1 additionally provided with a automatic document feeder (ADF) and a document image reading portion (scanner). In FIG. 6 whose horizontal axis represents time, the timings of the reading operation, the supply operation, the printing operation, and the cleaning processing are shown, respectively.

The reading operation is an operation performed by the document image reading portion (not shown) for reading the image data of documents continuously supplied from the automatic document feeder (ADF), in which operation the reading is performed at the timings of the first sheet (P. 1), the second sheet (P. 2), the third sheet (P. 3), the fourth sheet (P. 4), the fifth sheet (P. 5), the sixth sheet (P. 6), the seventh sheet (P. 7), the eighth sheet (P. 8), etc.

The supply operation is a supply operation of the sheet 3 (sheet conveying operation) performed by the resist roller 16, in which operation the sheet 3 is supplied at the timings of the first sheet (P. 1), the second sheet (P. 2), the third sheet (P. 3), the fourth sheet (P. 4), the fifth sheet (P. 5), the sixth sheet (P. 6), the seventh sheet (P. 7), the eighth sheet (P. 8), etc. Here, after the above described reading operation of a predetermined page is completed, the supply operation of the corresponding page is performed. Note that the speed of the image forming operation (supply operation) is higher than that of the above described reading operation, and hence, for example, at the time of the supply operation of the sixth sheet (P. 6), the image forming operation (supply operation) catches up with the reading operation of the page. As a result, the supply operation is put on standby because the image data used for the image formation of the next page (seventh sheet) is not prepared. That is, the seventh sheet (P. 7) is adapted to be supplied after the lapse of a predetermined standby period (period of time at least for reading the seventh sheet (P. 7)) from when the sixth sheet (P. 6) is supplied.

The printing operation is an image forming operation applied to the sheet 3 and performed by the image forming portion 5 after the supply from the resist roller 16 and the like, and is adapted to end within a predetermined period of time after the supply operation is performed.

A cleaning process is configured to be performed while the printing operation is not performed (between the sheets). In the continuous copying mode, when the supply operation is performed prior to the reading operation, that is, when the sheet supply is put on standby, the cleaning processing is configured to be performed by utilizing the sheet supply standby time.

Specifically, as shown in the timing chart in FIG. 6, after the sixth sheet (P. 6) is supplied and printed, the cleaning processing is configured to be performed within the above described supply standby time (period shown by "ON" in FIG. 6).

Figure 8:
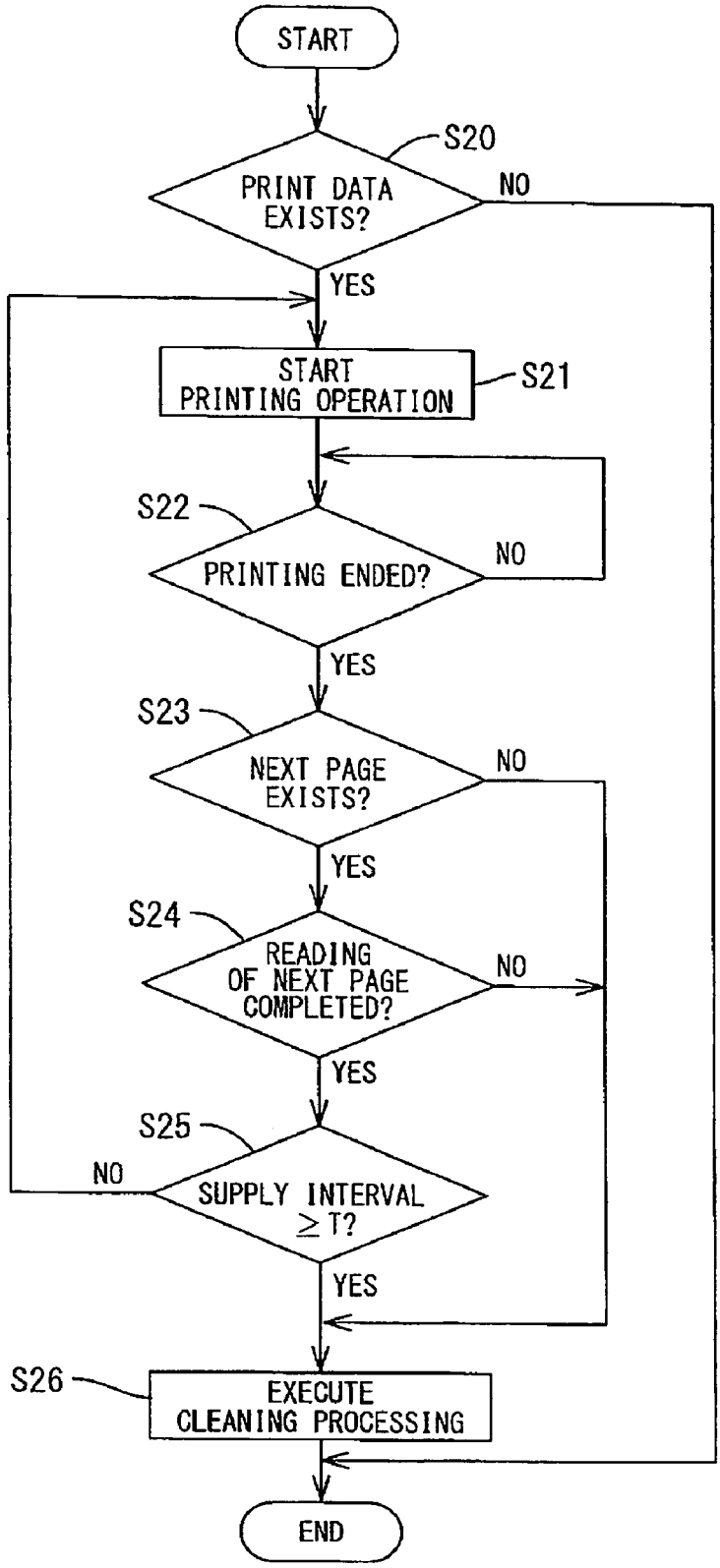
FIG. 8 is a flow chart showing a flow of cleaning processing control in a continuous copying mode.

FIG. 8 is a flow chart showing a flow of the cleaning processing control at the time of the continuous copying mode.

First, the presence and the absence of print data are confirmed in S20. When the print data exists, the process proceeds to S21, in which the printing operation is started. When the print data does not exist, the processing is ended. Then, when it is confirmed that the printing for one page is completed (YES in S22), the presence and absence of the next page are confirmed in S23. When the next page does not exist (NO in S23), the process proceeds to S26, in which the cleaning processing is performed. When the next page exists (YES in S23), it is confirmed whether or not the reading of the next page is completed in S24. When the reading of the next page is not completed (NO in S24), the process proceeds to S26, in which the cleaning processing is performed. When the reading of the next page is completed (YES in S24), the process proceeds to S25, in which the sheet supply interval is confirmed. Here, when the supply interval is T or longer (YES in S25; one example of a predetermined supply interval time), the cleaning processing is performed (S26). Further, when the sheet supply interval is confirmed in S25, and the supply interval is shorter than T (NO in S25), the process returns to the processing in S21. As described above, the supply interval T is set as the distance between the photoreceptor drum 33 (photoreceptor drum 33 at the right end in FIG. 1) in the most upstream side in the belt conveyance direction among the photoreceptor drums 33, and the photoreceptor drum 33 (photoreceptor drum 33 at the left end in FIG. 1) in the most downstream side.

Besides the above described cleaning process control, for example, in a temperature unevenness avoiding mode for avoiding the temperature unevenness in the fixing device 24, a cleaning process control is able to be configured.

Specifically, when the width of the supplied sheet 3 is narrower than the width of the fixing device 24, the end portion (sheet non-passing portion) of the fixing device 24 does not contribute to the fixation. When the temperature of the central portion (sheet passing portion) contributing to the fixation is to be maintained at a fixed temperature, the end portion (sheet non-passing portion) of the fixing device 24 may be excessively heated.

Thus, the mode for avoiding this is the temperature unevenness avoiding mode. In order to avoid the overheating (especially the overheating of the sheet non-passing portion) of the fixing device 24, the supply interval is adapted to be extended, thereby enabling the control for executing the above described cleaning processing to be performed during the "extended" sheet supply interval (one example of a predetermined supply interval time).

Further, when the printing for each predetermined job is performed, the cleaning processing may also be adapted to be executed between the jobs. For example, when the control for "extending" the sheet supply interval is performed between a first print job transmitted from a first terminal and a second print job transmitted from a second terminal, it is possible to perform the cleaning processing by utilizing the extended supply interval. That is, it may be adapted that the control portion 80 issues to the feeder portion 4 (resist roller 16 and the like) a signal (or a supply operation command) to "extend" the supply interval between the currently received first print job (preceding print job) and the subsequent second print job (subsequent print job), and issues another signal (or a cleaning processing execution command) to the cleaning portion A (see FIG. 2) during the "extended" supply interval.

Figure 9:
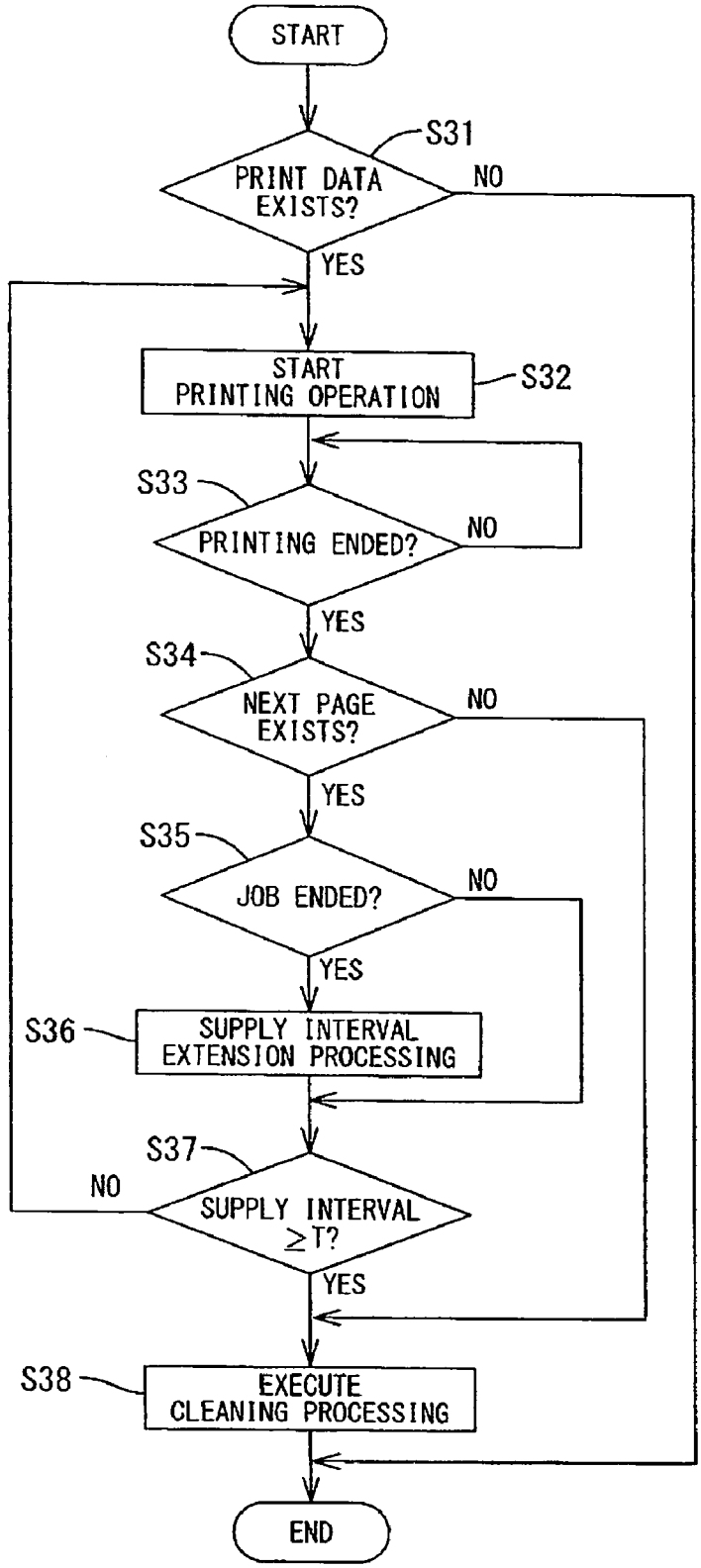
FIG. 9 is a flow chart showing a flow of cleaning processing control for utilizing an interval between jobs.

FIG. 9 is a flow chart showing a flow of the cleaning processing control between the jobs.

First, the presence and absence of print data are confirmed in S31. When the print data exist, the process proceeds to S32, in which the printing operation is started. When the print data does not exist, the processing is ended. Then, when the completion of printing of one page is confirmed (YES in S33), the presence of the next page is confirmed in S34. When the next page does not exist (NO in S34), the process proceeds to S38, in which the cleaning processing is performed. When the next page exists (YES in S34), it is confirmed in S35 whether or not the job (currently received job) is completed. When the job is not completed (NO in S35), the process proceeds to S37 as is. On the other hand, when the job is completed (YES in S35), the supply interval extending processing for "extending" the supply interval (one example of a predetermined supply interval time) is performed (S36), and then the process proceeds to S37. Note that, as described above, the supply interval extending processing is performed on the basis of the supply operation command to the feeder portion 4 (resist roller 16 and the like).

In S37, when the supply interval (sheet supply interval) is confirmed and the supply interval is T or longer (YES in S37), the cleaning processing is performed (S38). Further, in S37, when the sheet supply interval is confirmed and the supply interval is shorter than T (NO in S37), the process returns to the processing in S32. As described above, the supply interval T is set as the distance between the photoreceptor drum 33 (photoreceptor drum 33 at the right end in FIG. 1) in the most upstream side in the belt conveyance direction among the photoreceptor drums 33 and the photoreceptor drum 33 (photoreceptor drum 33 at the left end in FIG. 1) in the most downstream side.

By performing the above described cleaning processing control, the cleaning processing can be performed at the timing of the "long" sheet supply interval, without needlessly stopping the sheet supply, and the deterioration in the processing performance of printing and the like is also prevented, as a result of which it is possible to highly efficiently realize both the cleaning processing and the print processing.

As described above, various aspects of the present invention are described and shown, but the present invention is not so limited. For example, the following aspects are also included in the technical scope of the present invention.

(1) According to the above description, the cleaning processing control is adapted to be performed in all the modes of the double-side printing mode, the mode for interchangeably performing the monochromatic printing and the color printing, the facsimile mode, the continuous copying mode, and the temperature unevenness avoiding mode, but the present invention is not limited to this. For example, the above described cleaning processing control may also be adapted to be performed in any one or a plurality of modes among the double-side printing mode, the mode for interchangeably performing the monochromatic printing and the color printing, the facsimile mode, the continuous copying mode, and the temperature unevenness avoiding mode.

(2) According to the above description, the cleaning processing is configured to effectively perform during the "long" supply interval, but the present invention is not limited to this. For example, a a configuration may be adopted in which when the cleaning processing is judged to be unnecessary, the cleaning processing is not performed even during the "long" supply interval.

What is claimed is:

1. An image forming apparatus comprising:

a photoreceptor;

a photoreceptor cleaner configured to clean the photoreceptor;

a belt configured to be arranged opposite to the photoreceptor;

a belt cleaner configured to clean the belt;

a medium supplying device configured to perform supply operation of an image forming medium at a predetermined supply interval time; and a control device configured to perform cleaning processing when a cleaning processing time is less than the predetermined supply interval time.

2. The image forming apparatus according to claim 1, wherein the belt is a medium conveying belt configured to convey the image forming medium.

3. The image forming apparatus according to claim 1, wherein a plurality of the photoreceptors are arranged opposite the belt, and the photoreceptor cleaner is configured to clean each of the photoreceptors, and wherein the predetermined supply interval time is based on the distance between a most upstream side and the photoreceptor in a most downstream side among the plurality of photoreceptors.

4. The image forming apparatus according to claim 3, wherein the cleaning processing of each of the plurality of photoreceptors is configured to be done simultaneously.

5. The image forming apparatus according to claim 1, further including a double-side printing mode for forming images on a front and a rear of the image forming medium, wherein in the double-side printing mode, the medium supplying device is configured to determine the predetermined supply interval time based on a difference in the supply interval between when the front side is printed and when the rear side is printed.

6. The image forming apparatus according to claim 2, further including a double-side printing mode for forming images on a front and a rear of the image forming medium, wherein in the double-side printing mode, the medium supplying device is configured to determine the predetermined supply interval time based on a difference in the supply interval between when the front side is printed and when the rear side is printed.

7. The image forming apparatus according to claim 3, further including a double-side printing mode for forming images on a front and a rear of the image forming medium, wherein in the double-side printing mode, the medium supplying device is configured to determine the predetermined supply interval time based on a difference in the supply interval between when the front side is printed and when the rear side is printed.

8. The image forming apparatus according to claim 4, further including a double-side printing mode for forming images on a front and a rear of the image forming medium, wherein in the double-side printing mode, the medium supplying device is configured to determine the predetermined supply interval time based on a difference in the supply interval between when the front side is printed and when the rear side is printed.

9. The image forming apparatus according to claim 1, further comprising a fixing device configured to perform heat fixing processing of a developer image formed on the image forming medium, wherein the predetermined supply interval time is based on the temperature unevenness avoiding mode for avoiding temperature unevenness in the fixing device.

10. The image forming apparatus according to claim 2, further comprising a fixing device configured to perform heat fixing processing of a developer image formed on the image forming medium, wherein the predetermined supply interval time is based on the temperature unevenness avoiding mode for avoiding temperature unevenness in the fixing device.

11. The image forming apparatus according to claim 3, further comprising a fixing device configured to perform heat fixing processing of a developer image formed on the image forming medium, wherein the predetermined supply interval time is based on the temperature unevenness avoiding mode for avoiding temperature unevenness in the fixing device.

12. The image forming apparatus according to claim 4, further comprising a fixing device configured to perform heat fixing processing of a developer image formed on the image forming medium, wherein the predetermined supply interval time is based on the temperature unevenness avoiding mode for avoiding temperature unevenness in the fixing device.

13. The image forming apparatus according to claim 1, further including a facsimile mode configured to execute printing after receiving facsimile data, wherein the predetermined supply interval time is based on the facsimile mode.

14. The image forming apparatus according to claim 2, further including a facsimile mode configured to execute printing after receiving facsimile data, wherein the predetermined supply interval time is based on the facsimile mode.

15. The image forming apparatus according to claim 3, further including a facsimile mode configured to execute printing after receiving facsimile data, wherein the predetermined supply interval time is based on the facsimile mode.

16. The image forming apparatus according to claim 4, further including a facsimile mode configured to execute printing after receiving facsimile data, wherein the predetermined supply interval time is based on the facsimile mode.

17. The image forming apparatus according to claim 1, comprising a document reading device for continuously reading a plurality of documents, and configured to be capable of executing a copying mode for copying the documents, wherein the predetermined supply interval time is based on when the number of supplied sheets of the image forming medium reaches the number of sheets of the documents read by the document reading device.

18. The image forming apparatus according to claim 2, comprising a document reading device for continuously reading a plurality of documents, and configured to be capable of executing a copying mode for copying the documents, wherein the predetermined supply interval time is based on when the number of supplied sheets of the image forming medium reaches the number of sheets of the documents read by the document reading device.

19. The image forming apparatus according to claim 3, comprising a document reading device for continuously reading a plurality of documents, and configured to be capable of executing a copying mode for copying the documents, wherein the predetermined supply interval time is based on when the number of supplied sheets of the image forming medium reaches the number of sheets of the documents read by the document reading device.

20. The image forming apparatus according to claim 4, comprising a document reading device for continuously reading a plurality of documents, and configured to be capable of executing a copying mode for copying the documents, wherein the predetermined supply interval time is based on when the number of supplied sheets of the image forming medium reaches the number of sheets of the documents read by the document reading device.

21. The image forming apparatus according to claim 1, further including selectively executing monochromatic printing or color printing for each sheet, wherein the predetermined supply interval time is based on standby of the supply of the image forming medium at the time of performing switching between the monochromatic printing and the color printing.

22. The image forming apparatus according to claim 2, further including selectively executing monochromatic printing or color printing for each sheet, wherein the predetermined supply interval time is based on standby of the supply of the image forming medium at the time of performing switching between the monochromatic printing and the color printing.

23. The image forming apparatus according to claim 3, further including selectively executing monochromatic printing or color printing for each sheet, wherein the predetermined supply interval time is based on standby of the supply of the image forming medium at the time of performing switching between the monochromatic printing and the color printing.

24. The image forming apparatus according to claim 4, further including selectively executing monochromatic printing or color printing for each sheet, wherein the predetermined supply interval time is based on standby of the supply of the image forming medium at the time of performing switching between the monochromatic printing and the color printing.

25. The image forming apparatus according to claim 1, wherein the predetermined supply interval time is based on a currently received preceding print job and a subsequent print job.

26. The image forming apparatus according to claim 2, wherein the predetermined supply interval time is based on a currently received preceding print job and a subsequent print job.

27. The image forming apparatus according to claim 3, wherein the predetermined supply interval time is based on a currently received preceding print job and a subsequent print job.

28. The image forming apparatus according to claim 4, wherein the predetermined supply interval time is based on a currently received preceding print job and a subsequent print job.

29. An image forming apparatus comprising:

a photoreceptor;

a photoreceptor cleaner configured to clean the photoreceptor;

a belt configured to be arranged opposite to the photoreceptor;

a belt cleaner configured to clean the belt;

a medium supplying device configured to perform supply operation at different supply intervals of image forming medium, the medium supplying device having a long supply interval; and a control device adapted to perform cleaning processing during the long supply interval.

30. The image forming apparatus according to claim 29, wherein the belt is a medium conveying belt configured to convey the image forming medium.

31. The image forming apparatus according to claim 29, wherein a plurality of the photoreceptors are arranged opposite the belt, and the photoreceptor cleaner is configured to clean each of the photoreceptors, wherein the long supply interval time is based on the distance between a most upstream side and the photoreceptor in a most downstream side among the plurality of photoreceptors.

32. The image forming apparatus according to claim 31, wherein the cleaning processing of each of the plurality of photoreceptors is configured to be done simultaneously.

33. The image forming apparatus according to claim 29, further including a double-side printing mode for forming images on a front and a rear of the image forming medium, wherein in the double-side printing mode, the medium supplying device is configured to determine the long supply interval based on a difference in the supply interval between when the front side is printed and when the rear side is printed.

34. The image forming apparatus according to claim 29, further comprising a fixing device configured to perform heat fixing processing of a developer image formed on the image forming medium, wherein the long supply interval is based on the temperature unevenness avoiding mode for avoiding temperature unevenness in the fixing device.

35. The image forming apparatus according to claim 29, further including a facsimile mode configured to execute printing after receiving facsimile data, wherein the long supply interval is based on the facsimile mode.

36. The image forming apparatus according to claim 29, comprising a document reading device for continuously reading a plurality of documents, and configured to be capable of executing a copying mode for copying the documents, wherein the long supply interval is based on when the number of supplied sheets of the image forming medium reaches the number of sheets of the documents read by the document reading device.

37. The image forming apparatus according to claim 29, further including selectively executing monochromatic printing or color printing for each sheet, wherein the long supply interval is based on standby of the supply of the image forming medium at the time of performing switching between the monochromatic printing and the color printing.

38. The image forming apparatus according to claim 29, wherein the long supply interval is based on a currently received preceding print job and a subsequent print job.

* * * * *